US006393236B1

(12) United States Patent
Yamamoto

(10) Patent No.: US 6,393,236 B1
(45) Date of Patent: May 21, 2002

(54) BELT CARTRIDGE FOR PHOTOSENSITIVE BELT AND ELECTROPHOTOGRAPHIC PRINTER USING THE SAME

(75) Inventor: Kazuoki Yamamoto, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/690,752

(22) Filed: Oct. 18, 2000

(30) Foreign Application Priority Data

Oct. 20, 1999 (JP) ..... 11-298448

(51) Int. Cl.[7] ..... G03G 15/00; G03G 21/00
(52) U.S. Cl. ..... 399/116
(58) Field of Search ..... 399/116, 117, 399/162, 110; 206/303, 316.1, 493

(56) References Cited

U.S. PATENT DOCUMENTS 6,049,682 A * 4/2000 Goetzke et al. ..... 399/116
6,052,548 A * 4/2000 Yamamoto ..... 399/116
6,178,300 B1 * 1/2001 Lee et al. ..... 399/116 X
6,185,395 B1 * 2/2001 Lee ..... 399/116

FOREIGN PATENT DOCUMENTS

| | | |
|---|---|---|
| JP | 10-54126 | 2/1998 |
| JP | 10-172111 | 6/1998 |
| JP | 11-352837 | * 12/1999 |

* cited by examiner

*Primary Examiner*—Sophia S. Chen
(74) *Attorney, Agent, or Firm*—Sughrue Mion, PLLC

(57) ABSTRACT

A belt cartridge for a photosensitive belt and an electrophotographic printer using the same makes it possible that any member need not be beforehand prepared or stored for the replacement of the photosensitive belt and the hands and clothes of the user cannot become dirty with toner or the like. Rollers 7, 8, and 5 are moved in a direction of arrow D. Belt cartridge 10 in which photosensitive belt 2 is housed is inserted in electrophotographic printer 1 through an opening thereof. By moving roller 5 in a direction of arrow H, tension is applied to belt 2 to support belt 2 by rollers 3 to 6 of belt supporting and driving system 9. By sliding only outer cover 10*a*, the user separates and removes outer cover 10*a* from printer 1.

23 Claims, 4 Drawing Sheets

BELT CARTRIDGE FOR PHOTOSENSITIVE BELT AND ELECTROPHOTOGRAPHIC PRINTER USING THE SAME

BACKGROUND OF THE INVENTION

The present invention relates to a belt cartridge for a photosensitive belt and an electrophotographic printer using the same, and in particular, to a photosensitive belt and an electro-photographic printer using the same including a holding section of a belt cartridge, the cartridge having a function to remove a photosensitive belt when the belt becomes unusable because picture quality is deteriorated because a life of the belt is expired or before the expiration of its life of the belt.

DESCRIPTION OF THE PRIOR ART

In an electrophotographic printer of the prior art, when an old photosensitive belt which is unusable because of picture quality is deteriorated at or before the end of its life is to be replaced with a new photosensitive belt, the user removes by hand the old photosensitive belt attached without any cover in the electrophotographic printer and then installs the new photosensitive belt therein.

However, in this replacing procedure, the user directly touches the photosensitive belt on which toner is fixed. This leads to a problem that the hands and clothes of the user possibly become dirty with the toner on the photosensitive belt.

To solve problems of this kind, Japanese Patent Laid-Open Publication Nos. HEI 10-54126 and 10-172111 describe techniques to employ a lid of a belt cartridge to cover a photosensitive belt or an outer case to cover a photosensitive belt.

However, the lid or the outer case must be kept stored until the photosensitive belt is replaced. That is, the problem still exists, for example, when the lid or the outer case is lost.

SUMMARY OF THE INVENTION

It is therefore an object of the present invention to provide a belt cartridge of a photosensitive belt and an electrophotographic printer using the same in which the belt cartridge includes a belt storage or holder. The belt is kept installed together with the photosensitive belt in the printer until the photosensitive belt is replaced. In this configuration, it is not necessary to separately prepare or store any member required for the replacement of the photosensitive belt, and hence neither the hands nor the clothes of the user become dirty with toner or the like.

In accordance with one aspect of the present invention, there is provided, to achieve the object above, a belt cartridge for a photosensitive belt, comprising a holding unit for holding a photosensitive belt in a predetermined contour. The photosensitive belt, when the belt is mounted onto an electrophotographic printer, is inserted in said holding unit. The photo-sensitive belt, when the belt is demounted from an electrophotographic printer, is removed from the holding unit. The holding unit is mounted on the electrophotographic printer together with the photosensitive belt.

In accordance with one aspect of the present invention, the holding unit includes a plurality of holding sections each in a shape of a bar, the sections being parallel to a direction of the mounting and the demounting of the photosensitive belt and a fixing section for fixing the holding sections.

In accordance with one aspect of the present invention, the holding unit further includes a protecting unit formed to enclose a side surface of the holding unit. The protecting unit is removed after the photosensitive belt and said holding unit is mounted onto said electro-photographic printer.

In accordance with one aspect of the present invention, the holding sections are longer than the protecting unit in a direction of the mounting and the demounting of the photosensitive belt and have end edges bent on a side of the mounting and the demounting of the photosensitive belt. The bent end edges hold the photosensitive belt.

In accordance with one aspect of the present invention, the fixing section has a contour of a plate and fixes other end edges of the holding sections. The other end edges oppose to the end edges on the mounting and demounting side.

In accordance with one aspect of the present invention, the protecting unit includes a step section on an inner surface, thereof. The step section allows the photosensitive belt to pass therethrough.

In accordance with one aspect of the present invention, the predetermined contour of the photosensitive belt is analogous to that of a belt supporting and driving unit to support and to drive said photosensitive belt of the electro-photographic printer and is larger than that of the belt supporting and driving unit.

In accordance with one aspect of the present invention, there is provided an electrophotographic printer comprising a rotating developing unit changing a position thereof, a rotating transferring unit changing a position thereof, and a belt supporting and driving unit including a plurality of rollers, at least one of said rollers changing a position thereof. When the photosensitive belt is removed, tension applied to the photosensitive belt is released by moving the rotating developing unit, the rotating transferring unit, and the roller changing a position thereof. When the photosensitive belt is inserted, tension is applied to the photosensitive belt by restoring the rotating developing unit, the rotating transferring unit, and the roller changing a position thereof respectively to original positions thereof.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
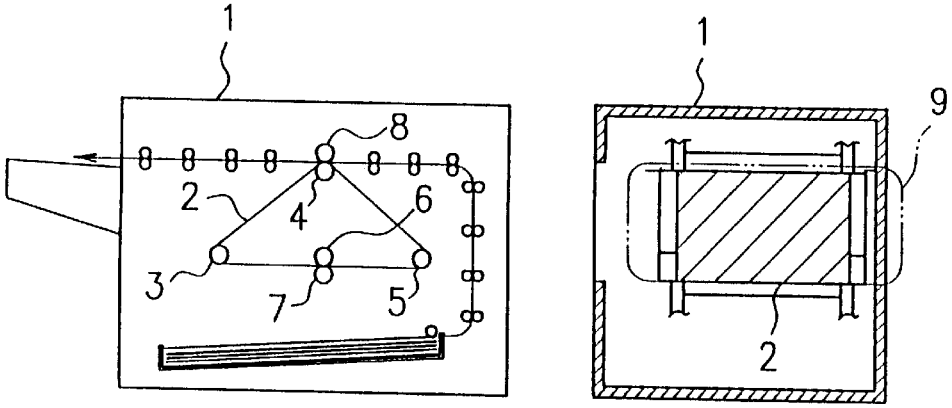
FIG. 1 is a schematic diagram showing constitution of an electrophotographic printer utilizing a photosensitive belt.

Referring next to the drawings, description will be given in detail of a belt cartridge of a photosensitive belt and an electrophotographic printer in accordance with the present invention.

The belt cartridge to store a photosensitive belt has a function in the electrophotographic printer to remove the photosensitive belt when the belt becomes unusable because picture quality is deteriorated at or before the end of a life of the belt. And the present invention is the electrophotographic printer which is using the before-mentioned belt cartridge of a photosensitive belt having the same function.

For this purpose, the belt cartridge of a photosensitive belt and the electrophotographic printer using the same are configured in an embodiment as shown in the drawing.

First, a description will be given of an electrophotographic printer using a photosensitive belt and a belt cartridge housing the belt.

FIG. 1 shows, in a schematic diagram, a configuration of an electrophotographic printer 1 using a photosensitive belt 2.

Belt 2 is supported by a belt supporting and driving system 9 (enclosed by a two-dot-and-dash line in the right-hand section of FIG. 1), which drives photosensitive belt 2. System 9 includes rollers 3 to 6 and a frame holding these rollers. Rollers 3 to 6 support and drive belt 2.

Roller 7 is a developing roller in which an image is formed on the belt 2. Roller 8 is a transfer or copy roller in which the image is transferred or copied onto a recording medium.

Electrophotographic printer 1 employing photosensitive belt 2 requires a belt cartridge to store photosensitive belt 2 to protect a photosensitive belt 2 against dust and light, photosensitive belt 2 being replaced with a new photosensitive belt 2 when necessary.

Figure 2A:
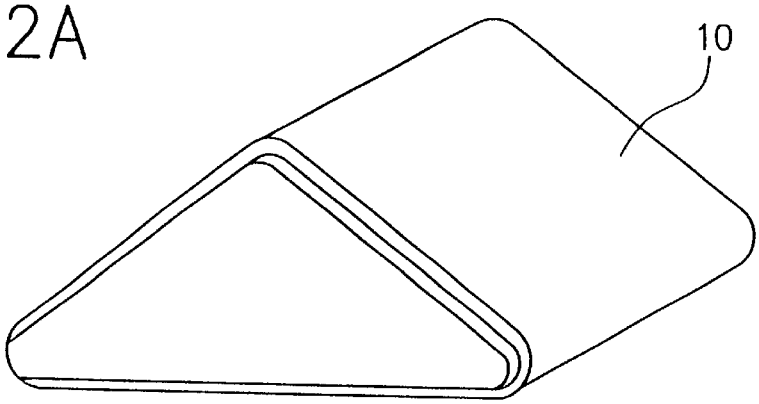
FIGS. 2A and 2B are perspective views showing an embodiment of a belt cartridge to store a photosensitive belt.
Figure 2B:
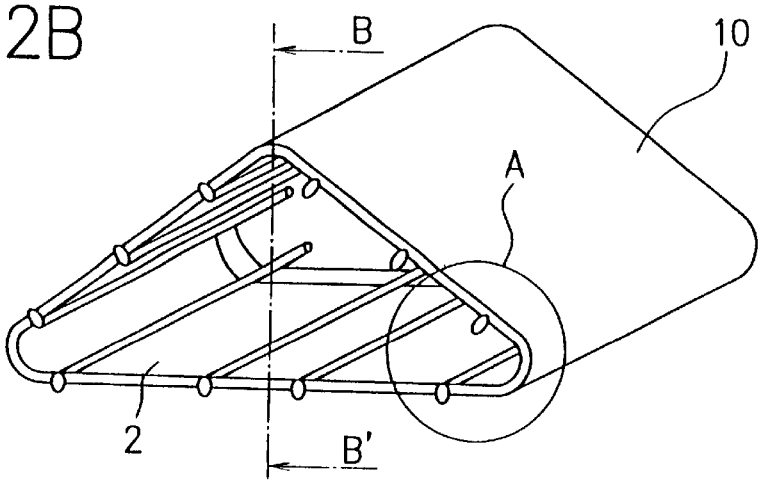

FIGS. 2A and 2B show, in schematic perspective views, an embodiment of a belt cartridge 10 to store a photosensitive belt 2 in accordance with the present invention. The belt cartridge has a function to easily mount photosensitive belt 2 on electrophotographic printer 1 without any damage on photosensitive belt 2 during the mounting thereof.

Belt cartridge 10 is to be inserted in belt supporting and driving system 9 and is therefore constructed in a size analogous to and slightly larger than that of system 9. For the same reason, belt cartridge 10 provides an opening as shown in FIGS. 2A and 2B.

FIGS. 2A and 2B respectively show appearances viewed respectively from an opening side and from a side opposite to the opening side. Therefore, photosensitive belt 2 is installed in belt cartridge 10 in a state in which belt 2 follows a side surface of cartridge 10. In this state, an upper surface of belt 2 is protected against dust and light by the side surface of cartridge 10.

Figure 3:
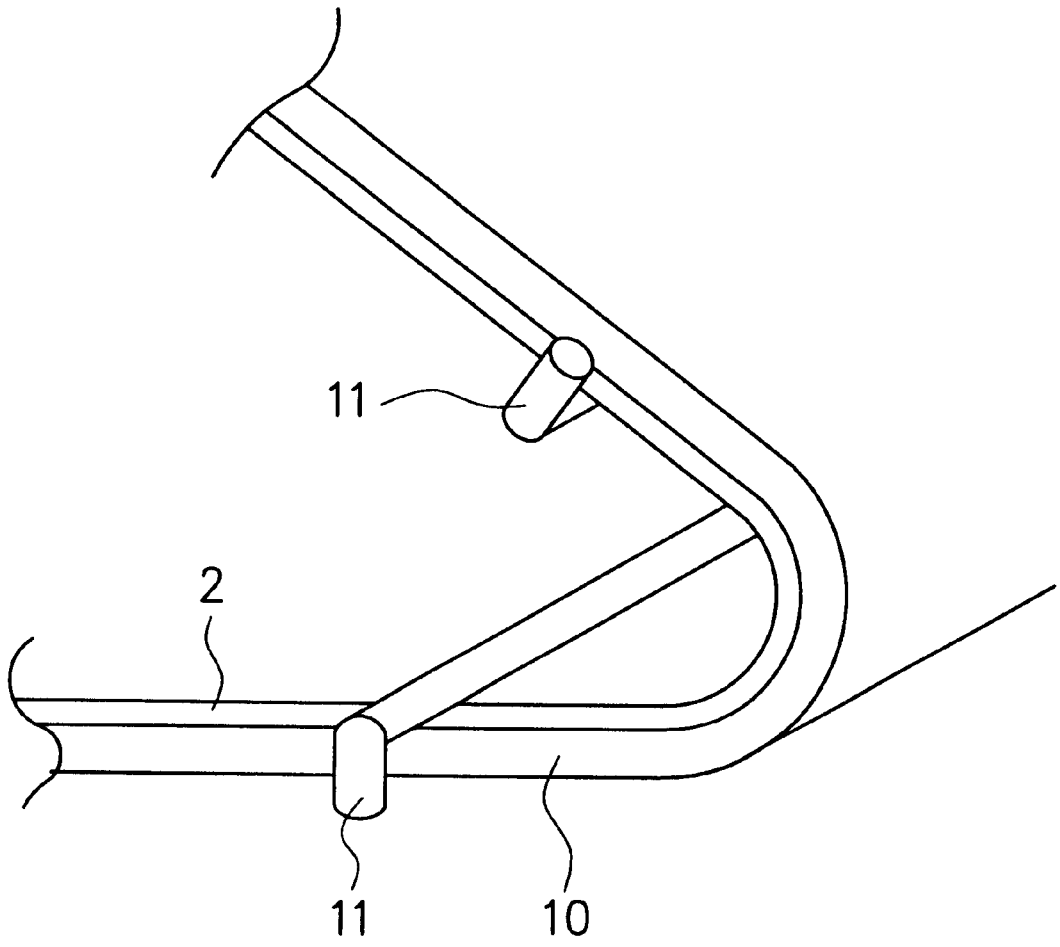
FIG. 3 is a magnified view of a section A of FIG. 2.

FIG. 3 shows a magnified view of a section A of FIGS. 2A and 2B. Belt cartridge 10 includes, in its inner side, a plurality of bars 11 disposed on the side surface of cartridge almost parallel to each other. Bars 11 lead photosensitive belt 2 along the side surface of cartridge 10. Each bar 11 includes a tip section which extends over the opening of cartridge 10 and which is bent by a right angle with respect to the side surface of cartridge 10.

Figure 4A:
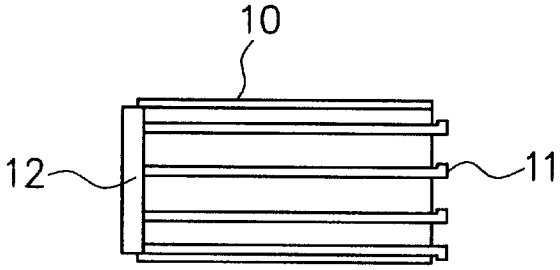
FIGS. 4A to 4D are cross-sectional views along a line B–B' of the belt cartridge of FIG. 2B viewed in a direction as indicated by an arrow B.
Figure 4B:
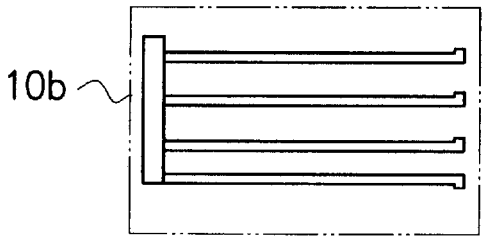

FIG. 4A shows a cross section of belt cartridge 10 along a line B–B', viewing from a direction of an arrow B, of FIG. 2B. Each bars 11 has another tip section which opposes to that on the opening side and which is attached onto a plate 12 as a bottom section of cartridge 10. In belt cartridge 10, as can be seen from FIGS. 4B to 4D, photosensitive belt 2, an outer cover 10*a*, and a belt holding section 10*b*, including bars 11 and plate 12 are slidably configured and hence can be separated from each other. These constituent sections are slidable to be separated from each other.

Figure 4C:
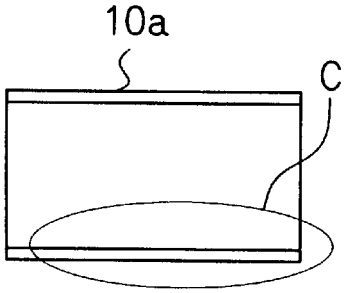
Figure 4D:
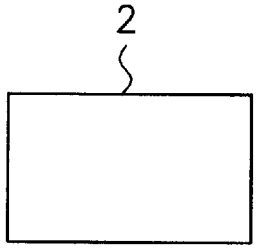
Figure 5:
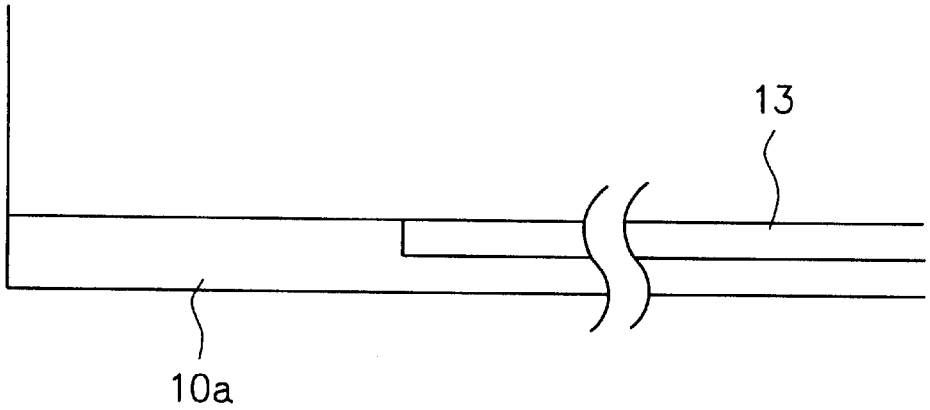
FIG. 5 is a magnified cross-sectional view of a section C of FIG. 4C.

FIG. 5 shows a magnified view of a section C of FIG. 4C. Outer cover 10*a* has a step section 13 in an inner side thereof. Step section 13 is a gap between outer cover 10*a* and belt holding section 10*b*. Photosensitive belt 2 is inserted into the gap and is held in a state in which belt 2 is placed along outer cover 10.

Referring now to FIGS. 6A to 6F, description will be given of operation of the configuration example in the Embodiment, namely, mounting and demounting of the photosensitive belt using the belt cartridge.

Figure 6A:
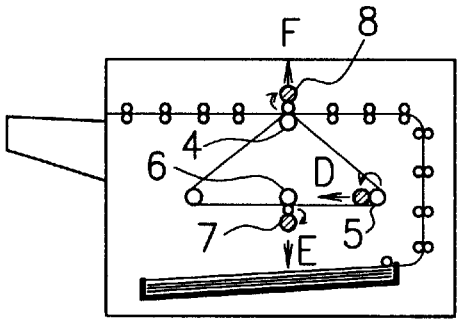
FIGS. 6A to 6F are schematic diagrams showing operation of the configuration example in the Embodiment.

As can be seen from FIG. 6A, roller 7 is first moved in a direction of an arrow E and roller 8 is moved in a direction indicated by an arrow F to insert belt cartridge 10 in belt supporting and driving system 9. Roller 5 is also moved in a direction of an arrow D. Photosensitive belt 2 is not installed in electrophotographic printer 1 in this state.

Figure 6B:
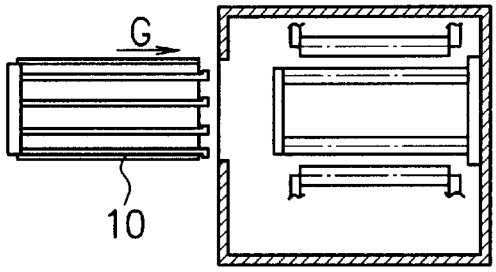

Subsequently, belt cartridge 10 in which photosensitive belt 2 is installed is inserted in printer 1 through its opening in a direction indicated by an arrow G as shown in FIG. 6B.

Figure 6C:
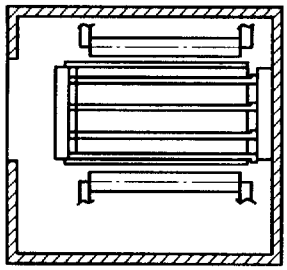
Figure 6D:
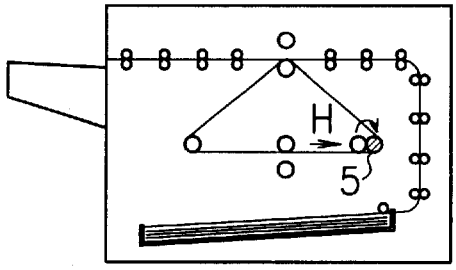

FIG. 6C shows a state in which belt cartridge 10 has been inserted in printer 1. Roller 5 is then shifted in a direction designated by an arrow H as shown in FIG. 6D. By moving roller 5 in the direction of arrow H, tension is applied to photosensitive belt 2 and is hence supported by rollers 3 to 6 of belt supporting and driving system 9. In this situation, rollers 3 to 6 can drive photosensitive belt 2.

Figure 6E:
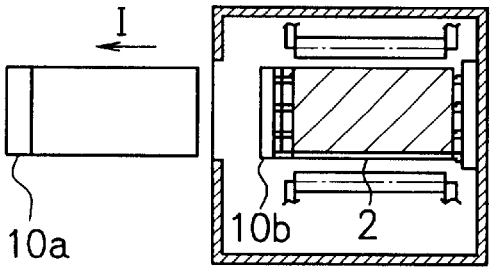

As shown in FIG. 6E, the user slides only outer cover 10*a* through the opening in a direction indicated by arrow I remove outer cover 10*a* from belt cartridge 10, namely, from printer 1. In this situation, photosensitive belt 2 and belt holding section 10*b* are kept remained in printer 1, and photosensitive belt 2 is installed in belt supporting and driving system 9.

Thereafter, rollers 7 and 8 are restored to original positions respectively thereof as shown in FIG. 6A. Electrophotographic printer 1 is in an operable state, i.e., is ready for a printing operation as shown in FIG. 6A. In FIG.6A, the circle shows roll after moving and the oblique lined circle shows before moving. FIGS. 6A and 6D, oblique lined circle shows the roll before moving and circle shows the roll moved after.

After printer 1 conducts printing jobs, when quality of pictures produced by printer 1 is deteriorated because the life of photosensitive belt 2 is expired or before expiration of the life thereof, photosensitive belt 2 is to be demounted from printer 1.

In the demounting of belt 2, since belt 2 and belt holding section 10*b* are installed in belt holding and driving system 9 as can be seen from FIG. 6A, it is required to move rollers 7, 8, and 5 respectively in directions indicated respectively by arrows E, F, and D to release tension applied to belt 2.

Figure 6F:
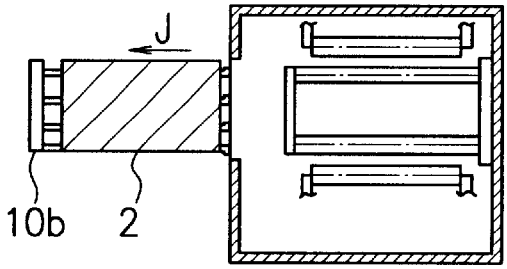

In the relaxed state of belt 2, belt holding section 10*b* is drawn in a direction indicated by an arrow J to be removed the used photosensitive belt 2 from printer 1 via the opening thereof as shown in FIG. 6F.

In this situation, since the end section of each bar 11 on the opening side extends over the opening of the belt cartridge 10 and is bent so as to folding the photosensitive belt 2, more preferably by nearly a right angle with respect to the side surface of belt cartridge 10 as described in conjunction with FIG. 3, the bent section of bar 11 catches an end edge of belt 2 on an deepest side of printer 1. In consequence, when belt holding section 10*b* is removed from printer 1, photosensitive belt 2 is also drawn therefrom together with belt holding section 10*b*.

As a result, photosensitive belt 2 is completely demounted from printer 1. Thereafter, the user installs a new photosensitive belt in printer to thereby complete the belt replacement.

In this sequence of procedures, the user does not touch any section which has become dirty with toner. Consequently, the drawback that the hands and/or clothes of the user become dirty with toner can be prevented.

As above, in accordance with the present invention, there are provided a belt cartridge of a photosensitive belt and an electrophotographic printer using the same. In the electrophotographic printer using a photosensitive belt housed in the belt cartridge, the cartridge has a function in which when quality of pictures produced by the printer is deteriorated because the life of photosensitive belt is expired or before expiration of the life thereof, the cartridge removes photosensitive belt.

In accordance with the present invention, there can be provided a belt cartridge for a photosensitive belt and an electrophotographic printer using the same. Thanks to the cartridge and the printer, the user does not touch the photosensitive belt which is dirty with toner or the like. Therefore, in a case in which quality of pictures produced by the printer is deteriorated because the life of photosensitive belt is expired or for some reasons before expiration of the life thereof, when the user removes the unusable photosensitive belt, the hands and clothes of the user cannot become dirty with toner or the like.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. In an electrophotographic printer using a belt cartridge for a photosensitive belt, said electophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof;

said belt cartridge, comprising holding means for holding said photosensitive belt in a predetermined contour, wherein:

said photosensitive belt, when said belt is mounted onto said electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means comprising a plurality of holding sections each in a shape of a bar, said sections being parallel to a direction of the mounting and the demounting of said photosensitive belt; and a fixing section for fixing said holding sections.

2. In an electrophotographic printer using a belt cartridge for a photosensitive belt, said electophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof;

said belt cartridge, comprising holding means for said photosensitive belt in a predetermined contour, wherein:

said photosensitive belt, when said belt is mounted onto said electrophotographic printer, is inserted in said holding means;

said photosensitive belt, when said belt is demounted from said electrophotographic printer, is removed from said holding means; and said holding means is mounted on said electrophotographic printer together with said photosensitive belt; and said holding means further includes a protecting means removable after said photosensitive belt and said holding means are mounted onto said electrophotographic printer.

3. In an electrophotographic printer using a belt cartridge for a photosensitive belt, said electrophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof;

said belt cartridge, comprising holding means for holding said photosensitive belt in a predetermined contour, wherein:

said photosensitive belt, when said belt is mounted onto said electrophotographic printer, is inserted in said holding means;

said photosensitive belt, when said belt is demounted from said electrophotographic printer, is removed from said holding means;

said holding means is mounted on said electrophotographic printer together with said photosensitive belt;

a plurality of holding sections each in a shape of a bar, said sections being parallel to a direction of the mounting and the demounting of said photosensitive belt;

a fixing section for fixing said holding sections; and said holding means further includes a protecting means removable after said photosensitive belt and said holding means are mounted onto said electrophotographic printer.

4. A belt cartridge for a photosensitive belt, comprising holding means for holding said photosensitive belt in a predetermined contour, wherein:

said photosensitive belt, when said belt is mounted onto an electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means comprising a plurality of holding sections each in a shape of a bar, said sections being parallel to a direction of the mounting and the demounting of said photosensitive belt;

a fixing section for fixing said holding sections; and said holding sections are longer than a protecting means in a direction of the mounting and the demounting of said photosensitive belt, and each of said holding sections has a bent end edge holding said photosensitive belt.

5. A belt cartridge for a photosensitive belt, comprising holding means for holding said photosensitive belt in a predetermined contour, wherein:

said photosensitive belt, when said belt is mounted onto an electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means further includes a protecting means removable after said photosensitive belt and said holding means are mounted onto said electrophotographic printer; and said protecting means further includes a step section on an inner surface thereof, the step section allowing said photosensitive belt to pass therethrough.

6. A belt cartridge for a photosensitive belt, comprising holding means for said photosensitive belt in a predetermined contour, wherein:

said photosensitive belt, when said belt is mounted onto an electrophotographic printer, is inserted in said holding means;

said photosensitive belt, when said belt is demounted from said electrophotographic printer, is removed from said holding means;

said holding means is mounted on said electrophotographic printer together with said photosensitive belt;

a plurality of holding sections each in a shape of a bar, said sections being parallel to a direction of the mounting and the demounting of said photosensitive belt;

a fixing section for fixing said holding sections; and said holding means further includes a protecting means removable after said photosensitive belt and said holding means are mounted onto said electrophotographic printer; and said protecting means includes a step section on an inner surface thereof, the step section allowing said photosensitive belt to pass therethrough.

7. An electrophotographic printer using said belt cartridge for said photosensitive belt claimed in any one of claims 4, 5, and 6, said electrophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof.

8. In an electrophotographic printer using a belt cartridge for a photosensitive belt, said electrophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof;

said belt cartridge, comprising holding means for holding said photosensitive belt in a predetermined contour, wherein:

said photosensitive belt, when said belt is mounted onto said electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means comprising a plurality of holding sections each in a shape of a bar, said sections being parallel to a direction of the mounting and the demounting of said photosensitive belt;

a fixing section for fixing said holding sections; and said fixing section has a contour of a plate and fixes end edges of said holding sections opposed to end edges on the mounting and demounting side.

9. A belt cartridge for a photosensitive belt, comprising holding means for holding said photosensitive belt in a predetermined contour, wherein:

said photosensitive belt, when said belt is mounted onto an electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means comprising a plurality of holding sections each in a shape of a bar, said sections being parallel to a direction of the mounting and the demounting of said photosensitive belt;

a fixing section for fixing said holding sections;

said holding sections are longer than a protecting means in a direction of mounting and the demounting of said photosensitive belt, and each of said holding sections have a bent end edge holding said photosensitive belt; and said predetermined contour of said photosensitive belt is analogous to that of a belt supporting and driving means to support and to drive said photosensitive belt of said electrophotographic printer and is larger than that of the belt supporting and driving means.

10. A belt cartridge for a photosensitive belt, comprising holding means of holding said photosensitive belt in a predetermined contour, wherein:

said photosensitive belt, when said belt is mounted onto an electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means further includes a protecting means removable after said photosensitive belt and said holding means are mounted onto said electrophotographic printer;

said protecting means further includes a step section on an inner surface thereof, the step section allowing said photosensitive belt to pass therethrough; and predetermined contour of said photosensitive belt is analogous to that of a belt supporting and driving means to support and to drive said photosensitive belt of said electrophotographic printer and is larger than that of belt supporting and driving means.

11. An electrophotographic printer using said belt cartridge for said photosensitive belt claimed in any one of claims 9 and 10, said electrophotographic printer comprising:

rotating developing means changing a position thereof;

rotating transferring means changing a position thereof; and said belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof.

12. In an electrophotographic printer using a belt cartridge for a photosensitive belt, said electophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof;

said belt cartridge, comprising holding means for holding said photosensitive belt in a predetermined contour, wherein:

said photosensitive belt, when said belt is mounted onto said electrophotographic printer, is inserted in said holding means;

said photosensitive belt, when said belt is demounted from said electrophotographic printer, is removed from said holding means;

said holding means is mounted on said electrophotographic printer together with said photosensitive belt and said holding means comprising a plurality of holding sections each in a shape of a bar, said sections being parallel to a direction of the mounting and the demounting of said photosensitive belt;

a fixing section for fixing said holding sections;

said fixing section has a contour of a plate and fixes end edges of said holding sections opposed to end edges on the mounting and demounting side; and said predetermined contour of said photosensitive belt is analogous to that of said belt supporting and driving means to support and to drive said photosensitive belt of said electrophotographic printer and is larger than that of said belt supporting and driving means.

13. In an electrophotographic printer using a belt cartridge for a photosensitive belt, said electrophotographic printer comprising:

rotating developing means changing a position thereof;

rotating transferring means changing a position thereof; and belt supporting and driving means including a plurality of rollers, at least one of said rollers changing a position thereof, wherein:

when said photosensitive belt is removed, tension applied to said photosensitive belt is released by moving said rotating developing means, said rotating transferring means, and said at least one roller changing a position thereof; and when said photosensitive belt is inserted, tension is applied to said photosensitive belt by restoring said rotating developing means, said rotating transferring means, and said at least one roller changing a position thereof respectively to original positions thereof;

said belt cartridge comprising holding means for holding said photosensitive belt in a predetermined contour, wherein:

said photosensitive belt, when said belt is mounted onto said electrophotographic printer, is inserted in said holding means;

said photosensitive belt, when said belt is demounted from said electrophotographic printer, is removed from said holding means;

said holding means is mounted on said electrophotographic printer together with said photosensitive belt;

a plurality of holding sections each in a shape of a bar, said sections being parallel to a direction of the mounting and the demounting of said photosensitive belt;

a fixing section for fixing said holding sections;

said holding means further includes a protecting means removable after said photosensitive belt and said holding means are mounted onto said electrophotographic printer; and predetermined contour of said photosensitive belt is analogous to that of said belt supporting and driving means to support and to drive said photosensitive belt of said electrophotographic printer and is larger than that of said belt supporting and driving means.

14. A belt cartridge for a photosensitive belt of an image producing device, said cartridge comprising:

a belt holding section for supporting a photosensitive belt in a predetermined contour when said belt is mounted in said image producing device;

said belt holding section remains inside said image producing device during operation of said device; and said belt holding section extending outwardly of said belt to facilitate operator removal of said cartridge from said image producing device.

15. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device; and said belt holding section comprising a plurality of individual holding sections.

16. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device;

said belt holding section comprising a plurality of individual holding sections; and said holding sections comprising bars, substantially parallel to each other and the direction of insertion of the cartridge, disposed on a side surface of the cartridge.

17. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device;

said belt holding section comprising a plurality of individual holding sections;

said holding sections comprising bars, substantially parallel to each other and the direction of insertion of the cartridge, disposed on a side surface of the cartridge;

said bars further include proximal ends and distal ends;

said distal ends are at the end of the cartridge that is inserted into said image producing device; and said distal ends are bent radially outward to hold said belt during cartridge removal.

18. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device;

said belt holding section comprising a plurality of individual holding sections;

said holding sections comprising bars substantially parallel to each other and the direction of insertion of the cartridge, disposed on a side surface of the cartridge;

said bars further include proximal ends and distal ends;

said proximal ends are attached to a plate shaped section; and said plate shaped section at the end of said cartridge opposite to that inserted into said image producing device.

19. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device; and said cartridge further comprising a removable protecting portion.

20. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device;

said cartridge further comprising a removable protecting portion; and said protecting portion includes a step section on an inner surface thereof to provide a storage area to protect an outer surface of said belt when said protecting portion is installed.

21. A belt cartridge for a photosensitive belt of an image producing device, said cartridge comprising:

a belt holding section for supporting a photosensitive belt in a predetermined contour when said belt is mounted in said image producing device;

said belt holding section extending outwardly of said belt to facilitate operator removal of said cartridge from said image producing device;

said belt holding section comprising a plurality of individual holding sections;

said holding sections comprising bars substantially parallel to each other and the direction of insertion of the cartridge, disposed on a side surface of the cartridge;

said bars further include proximal ends and distal ends, where:

said distal ends are at the end of the cartridge that is inserted into said image producing device;

said distal ends are bent radially outward to hold said belt during cartridge removal;

said cartridge further comprising a removable protecting portion; and said distal ends extend beyond said protecting portion when said protecting portion is installed.

22. A belt cartridge for a photosensitive belt of an image producing device, said cartridge comprising:

a belt holding section for supporting a photosensitive belt in a predetermined contour; when said belt is mounted in said image producing device;

said belt holding section extending outwardly of said belt to facilitate operator removal of said cartridge from said image producing device;

said belt holding section comprising a plurality of individual holding sections;

said holding sections comprising bars almost parallel to each other and the direction of insertion of the cartridge, disposed on a side surface of the cartridge;

said cartridge further comprising a removable protecting portion; and said protecting portion includes a step section on an inner surface thereof to provide a storage area to protect an outer surface of said belt when said protecting portion is installed.

23. A belt cartridge for a photosensitive belt of an image producing device, said cartridge comprising:

a belt holding section for supporting a photosensitive belt in a predetermined contour; when said belt is mounted in said image producing device;

said belt holding section extending outwardly of said belt to facilitate operator removal of said cartridge from said image producing device;

said belt holding section comprising a plurality of individual holding sections;

said holding sections comprising bars substantially parallel to each other and the direction of insertion of the cartridge, disposed on a side surface of the cartridge;

said bars further include proximal ends and distal ends, where:

said distal ends are at the end of the cartridge that is inserted into said image producing device;

and said distal ends are bent radially outward to hold said belt during cartridge removal;

said cartridge further comprising a removable protecting portion;

said protecting portion includes a step section on an inner surface thereof to provide a storage area to protect an outer surface of said belt when said protecting portion is installed;

said distal ends extend beyond said protecting portion when said protecting portion is installed.

* * * * *